US005373790A

United States Patent [19]

Chemiere et al.

[11] Patent Number: 5,373,790

[45] Date of Patent: Dec. 20, 1994

[54] SYSTEM FOR SELF DESTRUCTION OF A CARRIER SHELL SUBMUNITION BY CHEMICAL ATTACK

[75] Inventors: Patrice H. Chemiere, La Chapelle Saint Ursin; Jean-Paul A. Dupuy, Bourges; Bernard F. Bayard, Neuvy sur Barangeon; Jean-Pierre Ruet, Saint Germain du Puy, all of France

[73] Assignee: Giat Industries, Versailles, France

[21] Appl. No.: 70,220

[22] Filed: Jun. 2, 1993

[30] Foreign Application Priority Data

Jun. 2, 1992 [FR] France ..... 92-06630
Jun. 2, 1992 [FR] France ..... 92-06634

[51] Int. Cl.[5] ..... F42C 9/08; F42C 9/16; F42B 12/58

[52] U.S. Cl. ..... 102/226; 102/229; 102/257; 102/266

[58] Field of Search ..... 102/226, 227, 229, 230, 102/256, 266, 269

[56] References Cited

U.S. PATENT DOCUMENTS

| | | | |
|---|---|---|---|
| 1,806,877 | 10/1929 | Hale . | |
| 2,314,678 | 10/1941 | Zint . | |
| 3,559,580 | 2/1971 | Lyon . | |
| 3,998,164 | 12/1976 | Hadfield | 102/226 |
| 4,488,488 | 12/1984 | Looger et al. | 102/387 |
| 4,653,401 | 3/1987 | Gatti | 102/226 |
| 4,762,066 | 8/1988 | Rudenauer et al. | 102/226 |
| 4,873,927 | 10/1989 | Rudenauer | 102/226 |
| 4,998,476 | 3/1991 | Rudenauer et al. | 102/226 |
| 5,275,101 | 1/1994 | Chemiere et al. | 102/269 |

FOREIGN PATENT DOCUMENTS

| | | |
|---|---|---|
| 0189563 | of 0000 | European Pat. Off. . |
| 0205956 | 12/1986 | European Pat. Off. . |
| 116726 | 10/1899 | Germany . |
| 3538787 | 5/1987 | Germany . |
| 3543939 | 6/1987 | Germany . |
| 585026 | 1/1947 | United Kingdom . |

*Primary Examiner*—David Brown
*Attorney, Agent, or Firm*—Oliff & Berridge

[57] ABSTRACT

A mechanical system for self-destruction of a munition, in particular a carrier shell submunition, is provided in a munition having a warhead initiated by a pyrotechnic sequence, a main striker and a priming device composed of a slide movable between a safety position and an armed position and which has a device for priming the charge. The self destruction system includes a secondary striker mounted inside a receptacle of a slide and a control device to release the secondary striker after a preset delay. Secondary striker is integral with a holding element and held abutting a seat by the urging of an arming spring. The control device of the secondary striker has a corrosive agent designed to chemically attack the holding element to release it from its seat. When the holding element is released, secondary striker is translationally moved to contact the detonator to destroy the munition.

13 Claims, 14 Drawing Sheets

SYSTEM FOR SELF DESTRUCTION OF A CARRIER SHELL SUBMUNITION BY CHEMICAL ATTACK

BACKGROUND OF THE INVENTION

The present invention relates to a mechanical system for self-destruction of a munition provided with a warhead initiated by a pyrotechnic sequence, in particular a submunition dispersible by a vehicle such as a carrier shell.

The pyrotechnic sequence could comprise a main striker and a priming device composed of a slide movable from a safety position to an armed position and a means for priming the charge.

The self-destruct system comprises a secondary striker (or self-destruct striker) movable within a slide receptacle and designed to strike the primer means. It also comprises a device for activating the displacement of the secondary striker in the direction of the primer means after a preset delay.

In general, after a submunition has been ejected from a vehicle, the slide which carries the charge primer means enters the armed position. When the submunition comes in contact with the ground or a target, the main striker triggers the warhead by striking the primer means.

However, if the pyrotechnic charge should malfunction, the munition will not explode when it contacts the ground or a target. Nonetheless, once stable on the ground, the munition remains dangerous since any new impact could reset the pyrotechnic sequence function and cause the munition to explode.

To remedy this malfunction in the prior art, a submunition, carried in a carrier shell, is provided with a self-destruct system which causes the warhead to explode after a preset delay. This preset delay is greater than the free-fall flight time of the munition which ends when the munition reaches the ground or a target moving on the ground.

U.S. Pat. No. 4,873,927 describes a self-destruct system comprising a pyrotechnic delay which is initiated when the primer-carrying slide is armed. After certain burn-up time of the pyrotechnic sequence, priming of the warhead is initiated. Such a system has the drawback of being very cumbersome.

U.S. Pat. No. 4,998,476 describes a self-destruct system comprising a hydraulic or pneumatic piston. This piston abuts an oil chamber and moves when the volume of this chamber decreases upon opening of a calibrated orifice out of which the oil may flow when the slide enters the armed position. The piston is then displaced and at the end of its travel, it releases a striker which initiates the primer means of the warhead. Such a system is actually a micromechanism that requires high precision in design, assembly, and operation. Hence, it is highly sensitive to the outside environment and is expensive to build.

European Patent EP 0 205 956 describes a self-destruct system having a piston equipped with a secondary striker held by a pin. After ejection of the submunition and passage of the slide into the armed position, the pin gradually yields and breaks under the action of a spring after a given time interval. Such a system has the drawback of not being precise, since the delay is governed by the time the pin takes to fail, which is difficult to control.

British Patent GB 585,026 describes a delayed-action firing system for use with bombs. This system comprises an envelope filled with a solvent. The envelope is pierced when the bomb strikes a target resulting in solvent contacting a fusible washer. When the washer is dissolved, it releases a striker which is urged by a spring and initiates a primer. This system is relatively cumbersome and is difficult to build into a submunition dispersible by a vehicle, particularly in a "bomblet" dispersible by an artillery carrier shell. Also, this system is unreliable because it depends on impacting a target in a very specific direction.

U.S. Pat. No. 2,314,678 describes a self-destruct device for a bomb which has an acid reservoir broken by a hammer when a parachute opens. The acid then spreads in the device and corrodes a striker holding ring. This device is also very cumbersome. Moreover, it can only function in the vertical position because the acid depends on gravity to contact the ring.

German Patent DE 116,726 describes a device for initiating a primer after a delay. This device combines a sponge designed to receive a solvent and a soluble washer which holds a striker. Such a device requires "manual" placement of the solvent which cannot be adapted for self-destruction of a munition or submunition.

German Patent DE 353 87 87 describes a self-destruct system for a dispersible anti-tank submunition. This system has an ampule containing an acid designed to corrode the stem of the main striker. The acid ampule is broken when the striker is withdrawn. This occurs during the trajectory of the submunition and after the nut attached to the striker is unscrewed. The efficiency of this system is debatable because it is difficult to see how the striker could re-strike the primer to allow self-destruction.

U.S. Pat. No. 3,559,580 describes a timer for neutralizing an undersea mine. A battery supplies current to a system that contains an anode soluble in an electrolyte. When the anode is totally dissolved, it causes a valve to open allowing seawater to flow into the mine, which has the effect of neutralizing it. Such a device cannot easily be used to neutralize or destroy a munition, particularly a dispersible submunition. Moreover, it requires a substantial energy source.

SUMMARY OF THE INVENTION

The invention provides a device for self-destructing a munition which is better than known systems, particularly a system which is simple, inexpensive, and capable of acting with a delay that can be defined relatively precisely by comparison to known systems.

The invention also provides a self-destruct system of reduced size which is easy to install in a dispersible submunition. This system can also function regardless of the position of the submunition and has excellent reliability over the entire operational temperature range (from −40° C. to +60° C.).

The invention applies to a munition, particularly a submunition loaded into a vehicle such as a carrier shell. It could also apply to other types of munitions such as mines for example.

With a self-destruct system according to the invention, it is possible to determine relatively precisely the chemical reaction time required to release the secondary striker as a function of the type of corrosive agent, the holding element material and holding element dimensions.

One of the advantages of the self-destruct system according to the invention is that it is made of simple mechanical elements that are easy to implement and reliable in operation.

DETAILED DESCRIPTION OF PREFERRED EMBODIMENTS

Figure 1:
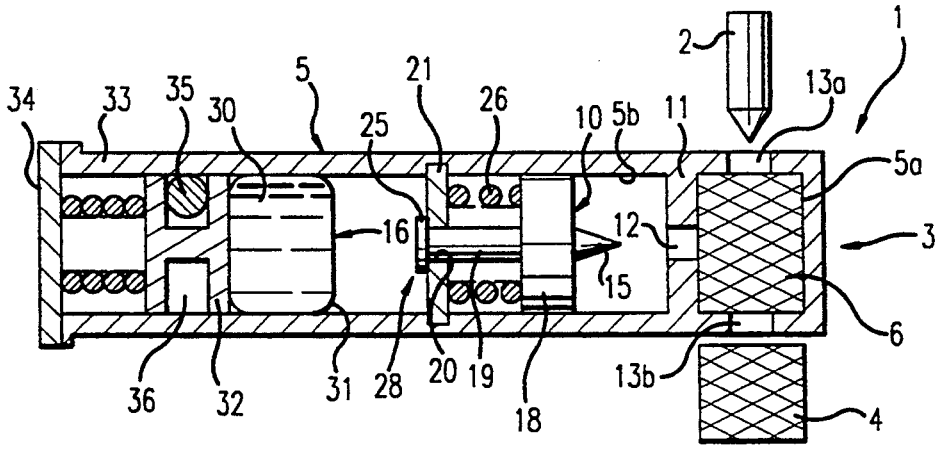
FIG. 1 is a schematic cross-section of a self-destruct system according to the invention.

According to a first embodiment, the subject of the invention is a system for self-destruction of a munition, particularly a submunition dispersible by a vehicle such as a carrier shell, comprising a priming device composed of a slide movable between a safety position and an armed position, which has a means for priming a warhead, said self-destruct system having a secondary striker mounted within a receptacle for the slide and movable between a safety position and a position in which the primer means is struck, and a control device releasing the secondary striker after a preset delay, this system being characterized in that:

the secondary striker is integral with a holding element designed to be held resting on a base under the urging of an arming spring, the base being disposed inside the slide receptacle;

the device controlling the secondary striker includes a corrosive agent contained in an envelope designed to attack the holding element chemically to release it from the base after said preset delay and cause the secondary striker to move in the direction of the primer means under the urging of the arming spring;

the system comprises a means for projecting the envelope in the direction of a holding element and a perforation means, the projecting means being comprised of a spring held in a tensioned state by a locking element which projects inside the slide;

sealing means are provided to prevent the corrosive agent from spreading in the slide receptacle after the envelope has been perforated and before the holding element is released. The envelope may be supported by a piston translationally movable under the urging of the spring.

According to a second embodiment, the self-destruct system comprises a priming device composed of a slide movable between a safety position and an armed position, which has a device for priming a warhead, wherein the self-destruct system comprises a secondary striker mounted inside a slide receptacle and movable between a safety position and a primer-means-striking position, and a control device for releasing the secondary striker after a preset delay. This system is characterized in that:

the secondary striker is integral with a holding element designed to be held resting on a base under the urging of an arming spring, the base being disposed inside the slide receptacle;

the control device of the secondary striker includes a corrosive agent contained in an envelope and designed to attack the holding element chemically to release it from the base after said preset delay and bring about displacement of the secondary striker in the direction of the primer means under the urging of the direction spring;

the system comprises a means for projecting the base, integral with the holding element, in the direction of the fixed element, and a means for perforating the envelope;

sealing means are provided to prevent the corrosive agent from spreading in the slide receptacle after the envelope has been perforated and before the holding element is released.

The projection means may be constituted by springs held under tension by a locking ball disposed inside the slide and located between the base and the envelope. The projection means releases the base when the slide moves into the armed position.

In this case, the base advantageously has two lateral wings which project outside the slide and on which the springs rest. The springs also rest on the body and allow the slide to move into the armed position.

According to a third embodiment, the means for projecting the base onto the envelope is comprised of a spring, one side of which rests on the base and the other side on the slide. The spring is maintained in a compressed state by a finger which joins the base to the slide.

In this case, the secondary striker is advantageously rendered integral with the base by the finger. In this position, the arming spring is held compressed between the base and the secondary striker while the holding element is not resting on the base. Withdrawal of the finger causes the holding element to act on the base by the action of the arming spring. The sealing means also comprise an O-ring disposed in a first annular recess provided on the outer surface of the base and a second O-ring disposed between the holding element and the base.

According to one particular embodiment, the finger can be ejected by a spring and is held in its base-immobilization position by a bolt whose axis is perpendicular to that of the finger. The bolt can then be ejected by a spring which is held in the compressed state by an adjacent submunition when the submunitions are loaded into the vehicle.

The system can also have an elastic tongue which keeps the spring in the compressed state before the submunition is loaded into the vehicle. This tongue is pushed aside by an adjacent submunition when the submunitions are loaded into the vehicle.

In the three embodiments described above, when the locking element of the envelope opening device containing the corrosive agent is released, the envelope is perforated. The holding element is brought into contact with the corrosive agent and is attacked chemically.

Moreover, the projection means also ensures that the corrosive agent is held under pressure after the envelope has burst. The sealing means prevent the corrosive agent from leaking while it is under pressure.

Such an arrangement ensures proper wetting of the holding element and hence good reproducibility of the conditions under which it is attacked by the corrosive agent.

As soon as the holding element is no longer resting on its seat, the secondary striker is released and urged by its associated spring in the direction of a primer means such as a detonator. Once the detonator has been struck, the charge is initiated and the munition is destroyed.

In general, the locking device of the envelope opening device containing the corrosive agent can be released when the slide passes into the armed position. In this case, operation of the self-destruct system is controlled by passage of the slide into the armed position. The second embodiment describes such a type of unlocking.

Release of the locking device can also be accomplished when the submunition is ejected from the carrier shell, for example, so that the self-destruct system operates regardless of the position of the slide. The third embodiment describes such a type of unlocking.

In the latter case, when the slide remains locked in the safety position, the munition does not self-destruct but is neutralized by destruction of the detonator.

The delay necessary for the corrosive agent to release the secondary striker must be calculated to be greater than the flight time in free-fall of the submunition which ends when the munition reaches the ground. This is to allow the main pyrotechnic charge to initiate the submunition charge when the submunition strikes the ground. The self-destruct system is designed to destroy the munition if the pyrotechnic charge fails after the submunition strikes the ground.

Other advantages, characteristics, and details of the invention will emerge from the explanatory description thereof hereinbelow with reference to the attached drawings, provided solely as examples.

Principles of the invention are illustrated in FIG. 1 with the representation of a pyrotechnic sequence 1 comprising a main striker 2, a priming device 3, and an explosive charge 4. Priming device 3 is composed of a translationally movable slide 5 which supports a detonator 6 designed to be struck by main striker 2 to initiate charge 4, in a known manner.

Slide 5 is movable between a safety position wherein detonator 6 is not aligned with the axis of striker 2 and an armed position where detonator 6 is located opposite the striker. The latter position is shown in FIG. 1. Priming device 3 interrupts the pyrotechnic sequence 1 because charge 4 cannot be initiated unless slide 5 has moved into the armed position.

Such a pyrotechnic sequence 1 is built into a munition, particularly in a carrier shell submunition, and for the reasons stated above, such a munition is equipped with a self-destruct system 10 connected to priming device 3 of pyrotechnic sequence 1. The function of this system is to self-destruct the munition after a preset delay if pyrotechnic sequence 1 should fail to function.

In general, the slide has two receptacles **5*a* and 5*b* separated from each other by an internal wall 11 provided with a through hole 12. Receptacle 5*a* contains detonator 6 and communicates with the outside by two diametrically opposite orifices 13*a* and 13*b* which are designed to be opposite main striker 2 and charge 4, respectively, when slide 5 is in the armed position. Receptacle 5*b* is designed to contain self-destruct system 10**.

Self-destruct system 10 has a secondary striker 15 (or self-destruct striker) and a control device 16 which releases striker 15 in the direction of detonator 6, after a preset delay.

Secondary striker 15 is attached to the front face of a piston 18 which is translationally movable in receptacle **5*b* of slide 5. The other face of piston 18 is extended by an axial rod 19 which freely passes through a central opening 20 in a radial base 21 mounted within receptacle 5*b***.

Axial rod 19 ends in a holding element 25 such as a collar. A spring 26 is mounted in a tensioned state around rod 19 and is connected to base 21 and piston 18 to apply holding element 25 around opening 20 of base 21 forming a seat 28.

Holding element 25 is preferably made in one piece with rod 19 and then may be attached to piston 18 by screwing rod 19 into piston 18, for example.

Control device 16 of secondary striker 15 comprises a corrosive agent 30 enclosed in an envelope 31 and a device for opening this envelope 31 to cause corrosive agent 30 to contact holding element 25.

The opening device of envelope 31 comprises a projection means comprised of a piston 32 which is translationally movable under the urging of a spring 33 and a perforation means preferably composed of holding element 25. Envelope 31 is preferably joined to the front face of piston 32 by gluing for example and spring 33 rests on the rear face of piston 32 and on a disk 34 which closes receptacle **5*b* of slide 5**.

A locking element 35 projects radially inside receptacle **5*b* to retain piston 32 and keep envelope 31 at a distance from holding element 25. Locking element 35, such as a pin for example, projects into a recess 36 provided at the peripheral surface of piston 32**.

Thus, when locking element 35 is released from recess 36 of piston 32, envelope 31 is projected by spring 33 onto holding element 25 and perforated thereby. After a certain delay, holding element 25, attacked chemically by corrosive agent 30, is no longer large enough to rest on seat 28.

Secondary striker 15 is then released and is urged by spring 26 so that it strikes detonator 6 through opening 12 of wall 11 which separates the two receptacles **5*a*** and 5*b* of slide 5. Detonator 6 initiates charge 4 which destroys the munition.

Figure 2:
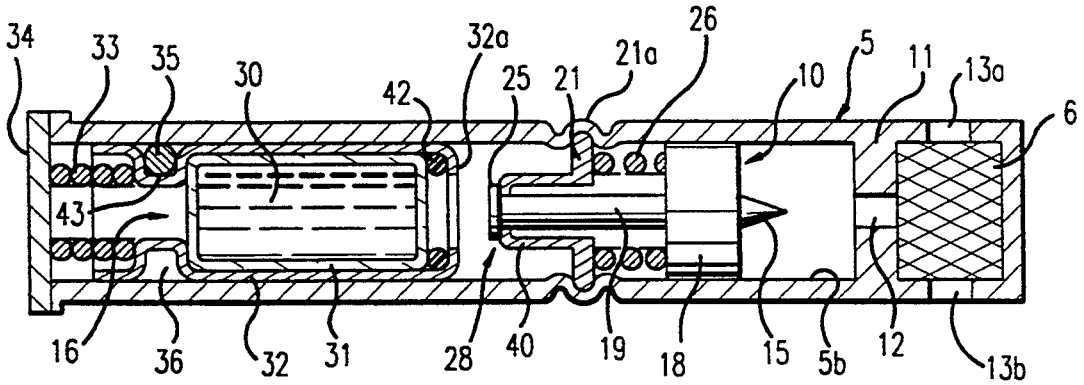
FIG. 2 is a partial axial cross-section view of a first embodiment of a self-destruct system according to the invention in its initial position before operation.

Self-destruct system 10 according to the first embodiment described above is shown in FIG. 2 with certain elements which will be described in detail to provide a concrete example.

Radial base 21 forms seat 28 for holding element 25 and has a hollow axial central enlargement having a bottom wall provided with an opening 20. Base 21 is preferably mounted inside receptacle 5*b* of slide 5 by a crimp 21*a*. Envelope 31 containing corrosive agent 30 may be a glass ampule for example, accommodated inside piston 32.

Piston 32 has the shape of a tubular element having one end that supports a sealing O-ring 42 which is held in place by an internal radial crease 32*a* provided at the one end of piston 32. At its other end, piston 32 has an internal annular enlargement 43 which corresponds with recess 36 for receiving locking element 35. Spring 33 which urges piston 32 rests between enlargement 43 and disk 34.

Envelope 31 is accommodated in piston 32 between enlargement 43 and sealing ring 42, and is attached to piston 32 by gluing for example.

As an example, holding element 25 is made of a metal material and corrosive agent 30 is an acid such as hydrochloric acid. Alternatively, holding element 25 can be made of a plastic material and corrosive agent 30 will then be a solvent such as acetone.

Figure 3:
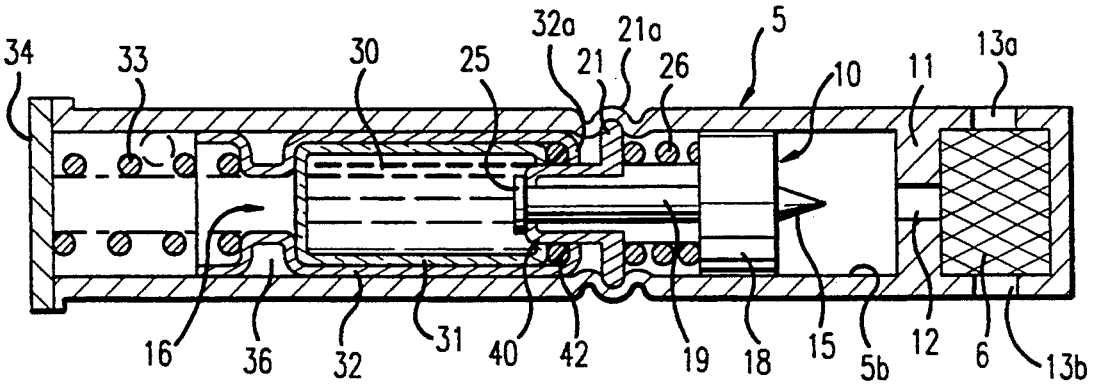
FIG. 3 is a partial axial cross-section view of the first embodiment illustrating an intermediate operational position.

When locking element 35 is released from slide 5, spring 33 pushes piston 32 and projects envelope 31 onto holding element 25 which perforates this envelope, as illustrated in FIG. 3.

Corrosive agent 30 is then in contact with holding element 25. Sealing ring 42 which rests on base 21 prevents the corrosive agent from spreading inside envelope 31. Envelope 31 does not burst but is perforated by holding element 25 in this example.

Figure 4:
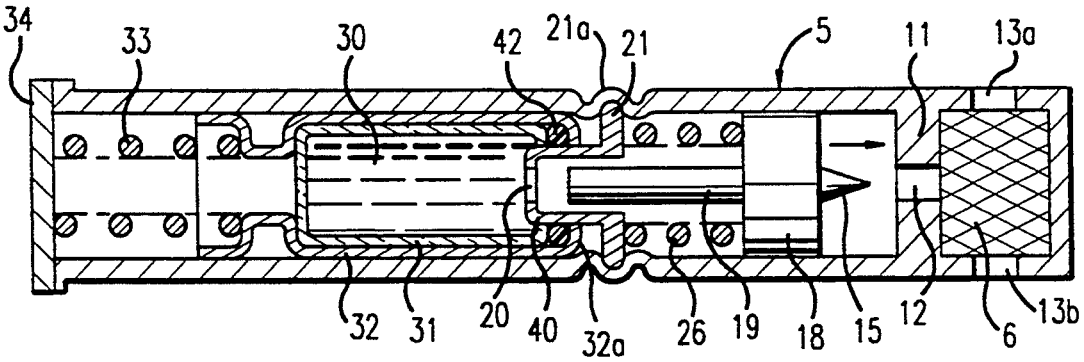
FIG. 4 is a partial axial cross-section view of the first embodiment illustrating the status of the system in a final operational position.

Following the chemical attack by corrosive agent 30, holding element 25 is destroyed and the secondary striker is released and pushed by spring 26, as illustrated schematically in FIG. 4.

Figure 5:
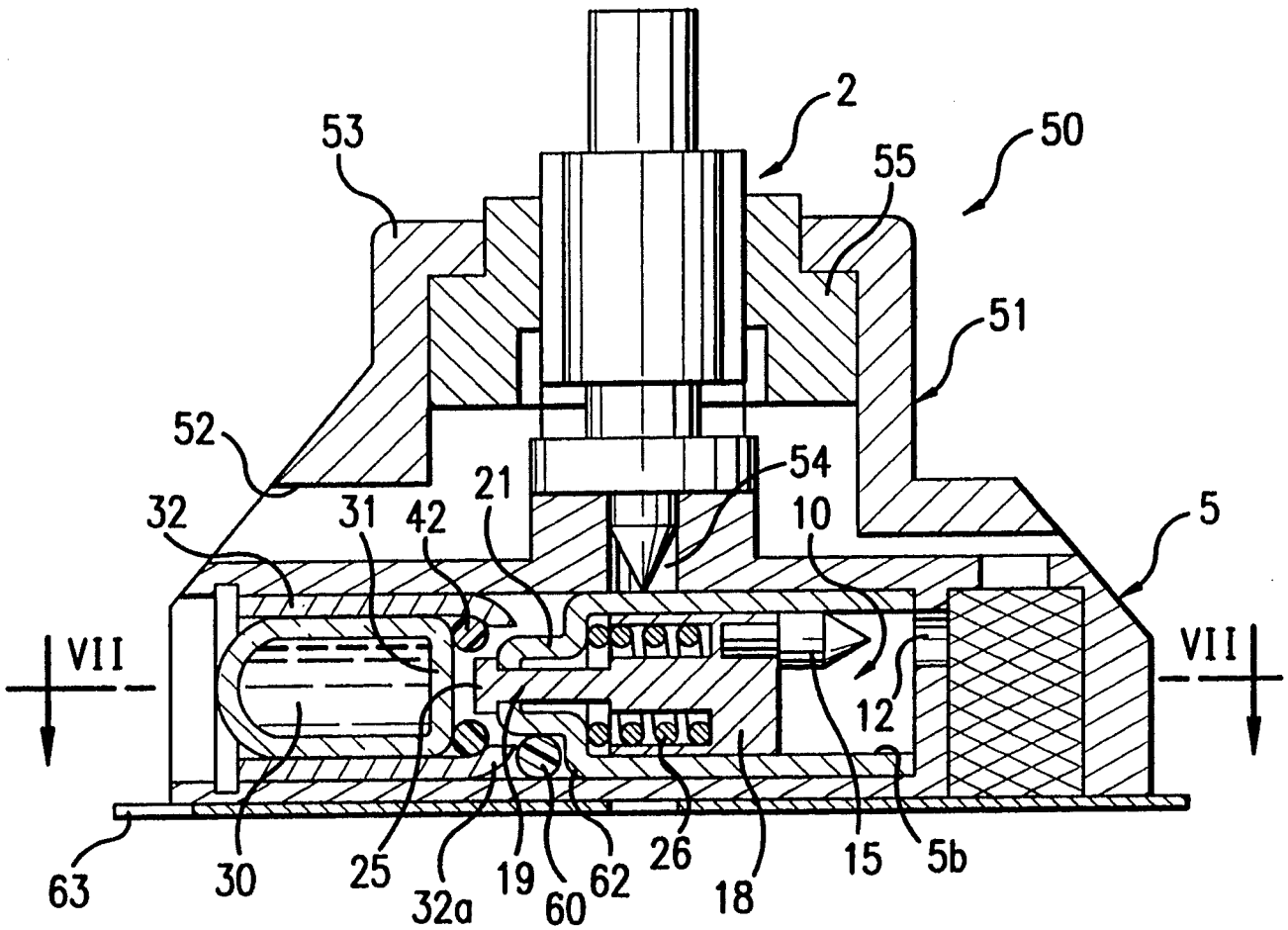
FIG. 5 is a partial axial section of a munition equipped with a self-destruct system according to a second embodiment of the invention, whereby the slide in which the self-destruct system is accommodated is shown in the safety position.
Figure 6:
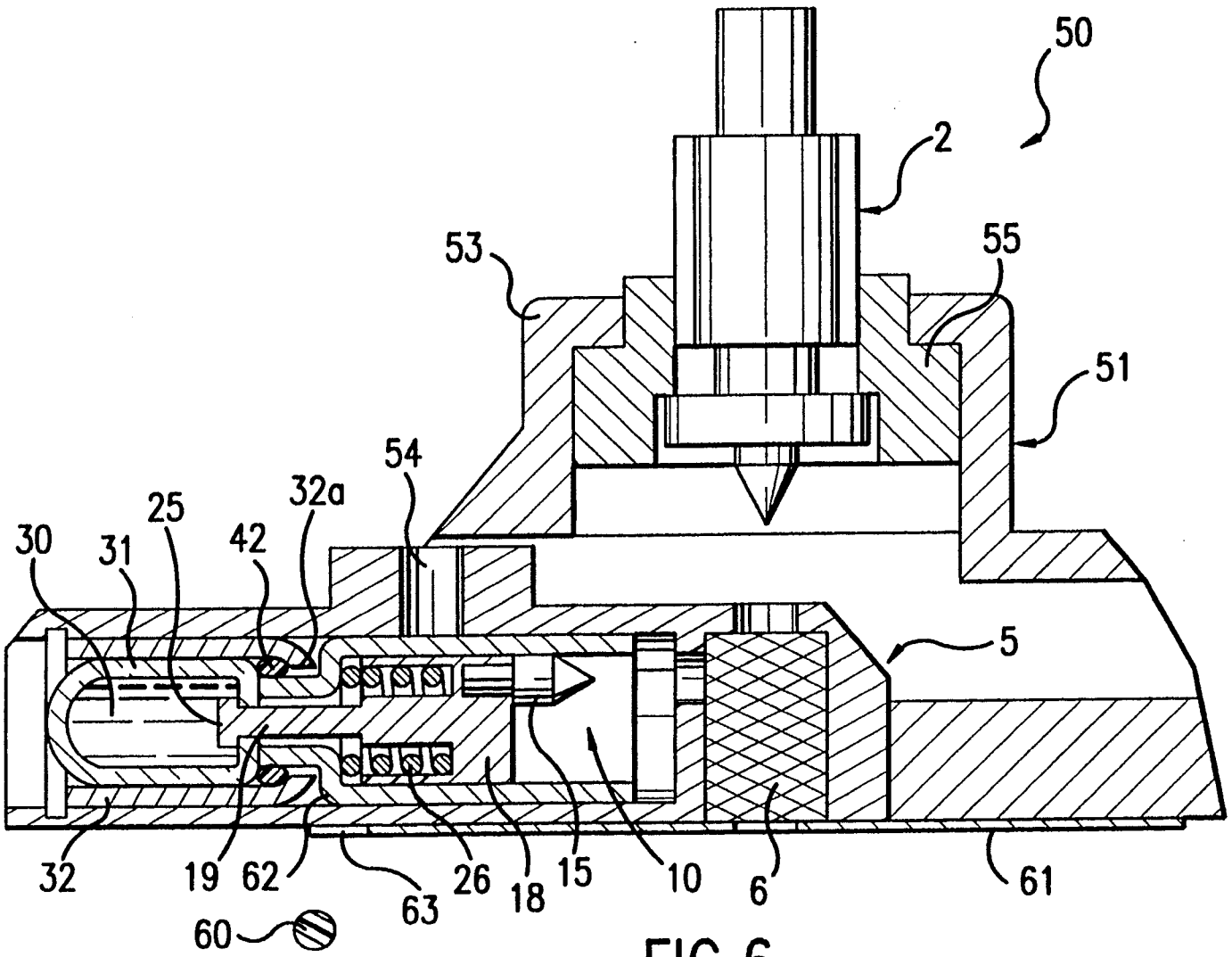
FIG. 6 is an axial section similar to that of FIG. 5 but with the slide shown in the armed position.
Figure 7:
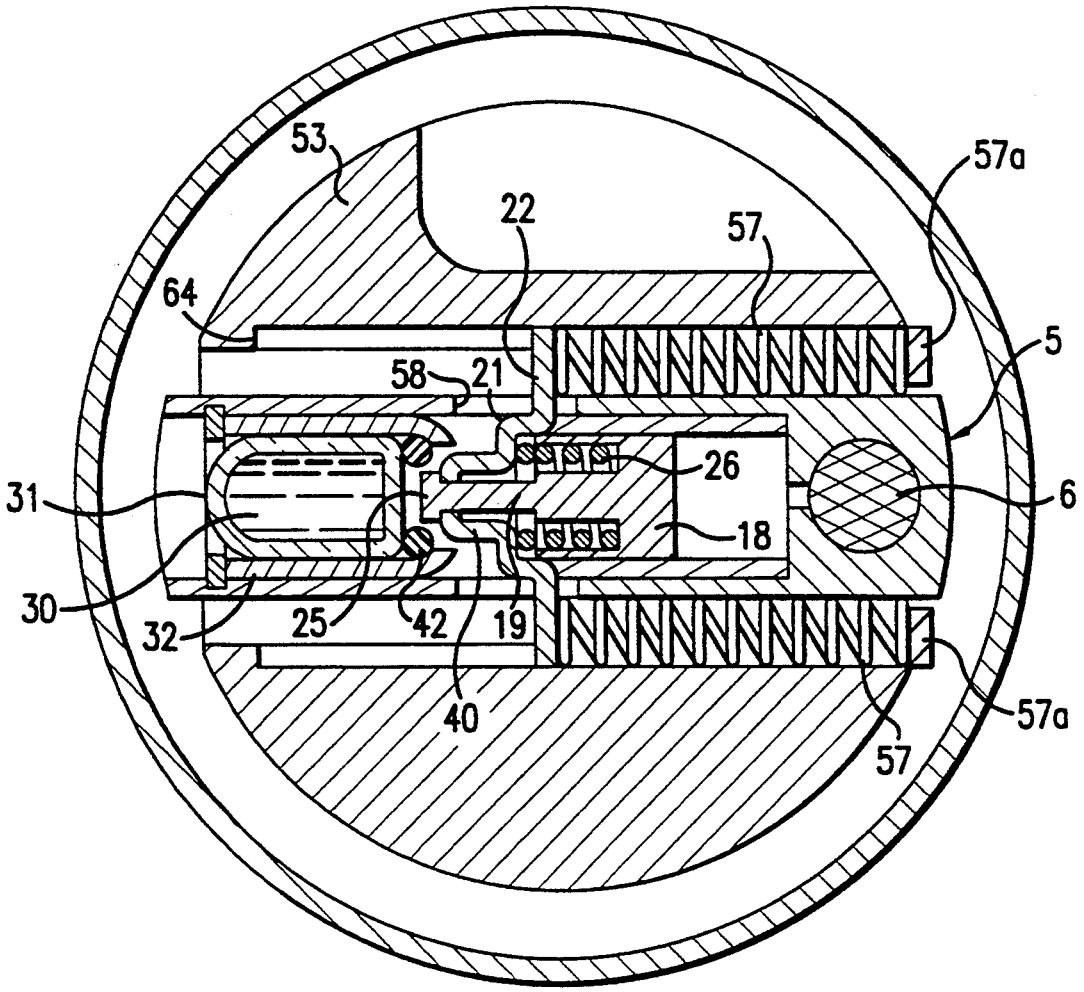
FIG. 7 is a cross-section view taken along line VII—VII in FIG. 5.

FIGS. 5 to 7 show partially a munition, in particular a submunition 50 carried in a carrier shell. This submunition is of the type described in greater detail in U.S. Pat. No. 4,488,488 and is also equipped with a self-destruct system 10 according to a second embodiment of the invention.

In general, submunition 50 has an envelope which accommodates the explosive charge. This envelope is surmounted with an arming safety device 51 which comprises main striker 2 and priming device 3 constituted by slide 5 which bears detonator 6.

For reasons of simplification and clarity, the illustration of submunition 50 has been deliberately confined to its safety and arming device 51 in which self-destruct system 10 is mounted.

With reference to FIG. 5, slide 5 is slidably mounted inside a receptacle 52 of body 53 of safety and arming device 51. It is held in the safety position in particular by main striker 2 which projects into a radial opening 54 in slide 5.

Main striker 2 is in a known manner screwed into a nut 55 which is rotationally integral with body 53. The slide cooperates with two springs 57 located on each side of slide 5 and allow it to move into the armed position (FIG. 7).

In self-destruct system 10 accommodated in slide 5, base 21 which forms seat 28 for holding element 25 is movable. Envelope 31 which contains corrosive agent 30 is fixed.

In this case, the holding element is made in one piece with piston 18 which bears secondary striker 15. From the assembly standpoint, spring 26 is first positioned in its receptacle of piston 18. Then rod 19, being integral with the piston, is introduced into the opening of base 21. The end of rod 19 is then crimped onto base 21 so as to form holding element 25.

As can be seen from FIG. 7, base 21 is extended laterally by two wings 22 which extend through side openings 58 outside of slide 5.

The two springs 57 rest on the two wings 22 so that the opening device of envelope 31 comprises a projection means composed of base 21 movable translationally under the urging of springs 57 and a perforation means which preferably comprises holding element 25.

The locking element which holds base 21 apart from envelope 31 as long as self-destruct system 10 is not activated is composed of a ball 60 which is interposed between base 21 and piston 32. Ball 60 is compressed by the action of springs 57 which rest between washers 57*a* crimped on body 53 and base 21. Ball 60 rests on a bottom plate 61 through an opening 62 provided in slide 5. Piston 32 has a conical crease 32*a* whose purpose is to hold sealing ring 42 and to facilitate ejection of ball 60, as will be explained below.

When the carrier shell has been fired, and at a given moment in time on its trajectory, the submunition is ejected outside the carrier shell (first phase or ejection phase).

In a second phase (or arming phase), a stabilizer strip (not shown) attached to main striker 2 is deployed when submunition 50 falls. This strip, under the effect of its aerodynamic drag combined with the rotational movement of submunition 50, brings about partial unscrewing of main striker 2 screwed into nut 55. Main striker 2 then clears opening 54 of slide 5. The slide 5 is pushed by arming springs 57 and moves translationally into its armed position shown in FIG. 6.

In the first stage, arming springs 57 push slide 5 by means of base 21 which comes to rest against ball 60 which itself comes to rest against piston 32 integral with slide 5.

In a second stage, slide 5 projects outside receptacle 52 in body 53 of safety and arming device 51. This displacement has the effect of causing opening 62 in slide 5 to line up with an opening 63 provided in bottom plate 61. Ball 60 is ejected through this opening. Ejection of the ball is facilitated by the conical shape of crease 32*a* of piston 32. After ejection of the ball, springs 57 project base 21 onto envelope 31 and holding element 25 perforates the latter.

Travel of slide 5 is arrested by lateral wings 22 of base 1 abutting against one surface of internal annular stop 64 provided in receptacle 52 (see FIG. 7). Slide 5 is then in its armed position shown in FIG. 6.

In a third phase which corresponds to the end of the fall to the ground of submunition 50, explosive charge 4 is initiated.

Initiation occurs in normal operation following percussion of detonator 6 by main striker 2, moved suddenly by the deceleration movement brought about by the impact of the submunition on a target or the ground.

If main striker 2 should fail, submunition 50 is not initiated and self-destruct system 10 takes over, initiating detonator 6 and causing submunition 50 to explode after a preset delay calculated to be longer than the time taken by submunition 50 to fall to the ground. This delay corresponds to the time taken by corrosive agent 30 to destroy holding element 25 which holds secondary striker 25.

In this case, however, if slide 5 has not entered the armed position, the self-destruct system is inoperative.

Thus, as an alternative, it is possible to arrange for pin 35 or locking ball 60 to be released following ejection of submunition 50 from the carrier shell, and not following the entry of slide 5 into its armed position.

For this purpose, one need only dispose a locking pin 35 in a radial direction relative to the axis of submunition 50 in a receptacle such that pin 35 is ejected by the force of centrifugal inertia regardless of the position of slide 5.

The value of such an arrangement is that it allows submunition 50 to be neutralized by destruction of detonator 6 after a certain delay, even if slide 5 is not in the armed position.

FIGS. 8 to 16 represent a third embodiment of the invention. FIGS. 8, 9, 15 and 16 represent slide 5 in which self-destruct system 10 and detonator 6 are placed.

The self-destruct system comprises secondary striker 15 (or self-destruct striker) which is mounted in an axial cylindrical receptacle 65 provided in base 21. It also comprises an envelope 31 which contains corrosive agent 30. The envelope 31 is made of glass and has a substantially cylindrical shape with an axis 29 perpendicular to axis 23 of base 21 and is terminated at one end by a tapered part. It is closed when filled by welding the tapered end. The ampule is closed so that a minimum amount of air remains inside after closure. High-temperature spot welding such as laser welding gives good results.

With such an arrangement, base 21 will burst envelope 31 at the cylindrical surface of the latter, which surface has lower mechanical strength than the bottom of envelope 31.

Envelope 31 is rendered integral with slide 5 by means of silicone-type resin plugs 24 which are cast over envelope 31 once the envelope has been positioned in a conical receptacle 27 provided in slide 5. Plugs 24 also damp impacts giving the envelope good resistance to environmental constraints of the munition (impacts, vibrations, etc.).

Base 21 has a generally cylindrical shape. It is placed in receptacle **5*b* of slide 5**.

A first O-ring 42 is disposed in an annular recess provided in the outer surface of base 21. This ring is, as described above, intended to prevent the corrosive agent from spreading outside the envelope when the envelope has been perforated.

The projection means of base 21 is constituted by a spring 59 which rests between internal wall 11 of slide 5 and a shoulder 66 of base 21. Spring 59 is kept compressed by a locking element composed of a finger 67 which passes through slide 5 at the level of a lateral opening **67*a* and penetrates base 21 through an orifice 67*b***.

Secondary striker 15 has a cylindrical part 68 slidably adjusted in receptacle 65, in which an annular recess 69 is provided. The end of finger 67 penetrates recess 69, thus ensuring axial locking of secondary striker 15 in receptacle 65.

Secondary striker 15 also has a threaded extension 70 onto which a cylindrical support 71, integral with holding element 25 (which has the shape of a collar here) is screwed. Cylindrical support 71 and holding element 25 constitute a single part made for example of a plastic material of the polycarbonate type.

Arming spring 26 rests between the cylindrical part 68 of secondary striker 15 and an internal partition 72 of base 21.

Arming spring 26 is kept compressed by finger 67 which penetrates recess 69 of cylindrical part 68 thus preventing any relative axial movement of secondary striker 15 and base 21.

In this position, holding element 25 is not held against internal partition 72. Such an arrangement avoids having to keep holding element 25 in a precompressed state during all the storage phases of the self-destruct system.

This improves the reproducibility of the time necessary for the corrosive agent to dissolve the holding element, and hence that of the self-destruction delay. Such an arrangement increases the reliability of the self-destruct system.

A second sealing O-ring 73 is disposed between holding element 25 and internal partition 72. This second ring is not compressed when the system is in the storage position shown in FIGS. 8 and 9. It is compressed when arming spring 26 applies holding element 25 against partition 72 as will be described hereinbelow.

Figure 15:
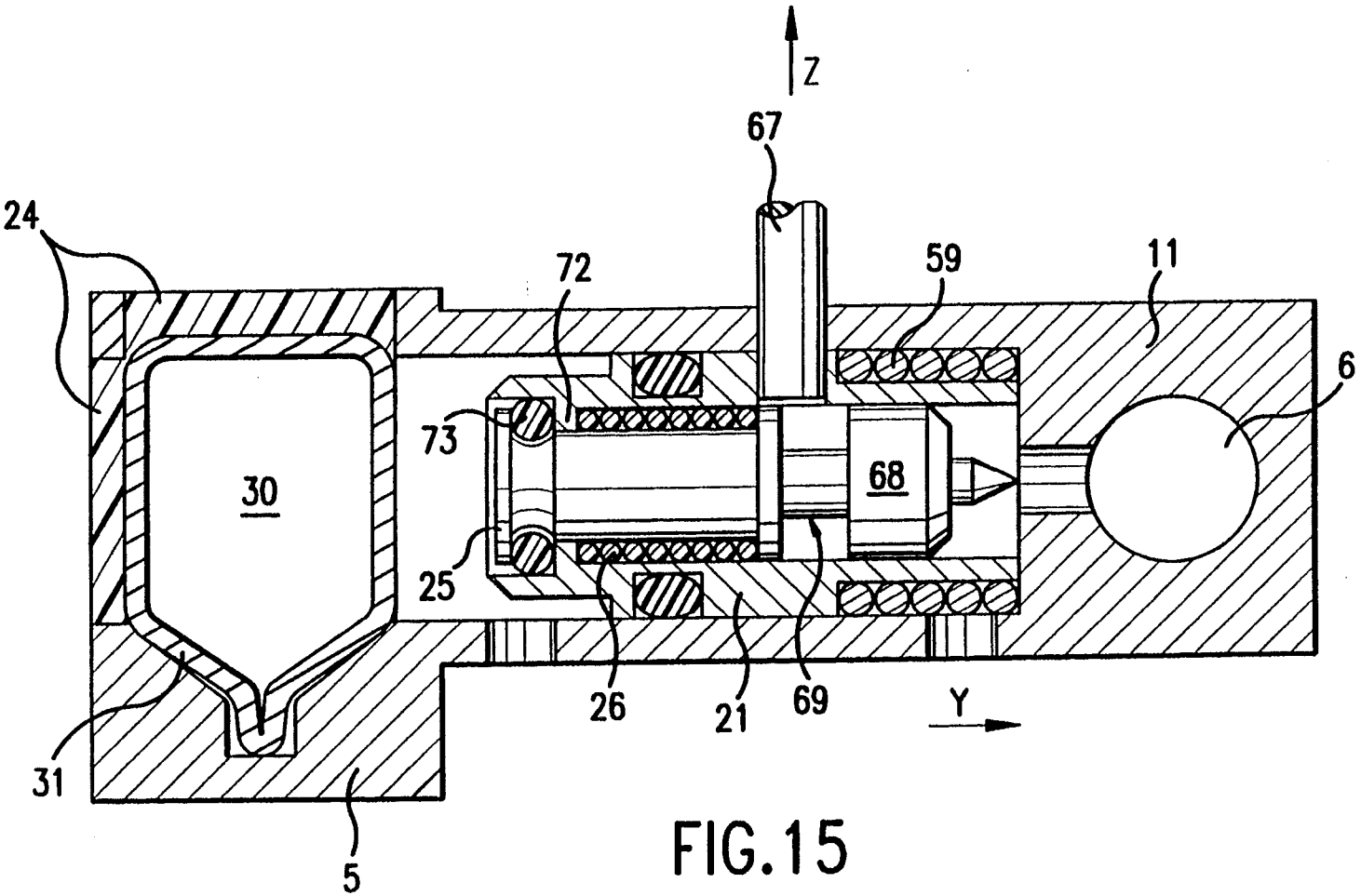
FIG. 15 is a cross-section view of FIG. 9 illustrating the system when the holding element is pre-stressed.

FIG. 15 shows this system at the time when finger 67 begins to be withdrawn from slide 5 in direction Z. When finger 67 leaves recess 69 of cylindrical part 68 of the secondary striker, the latter can move translationally in direction Y under the urging of arming spring 26. Arming spring 26 then applies holding element 25 against partition 72, thus causing second O-ring 73 to be compressed. Finger 67 continues to immobilize base 21 relative to slide 5.

Figure 16:
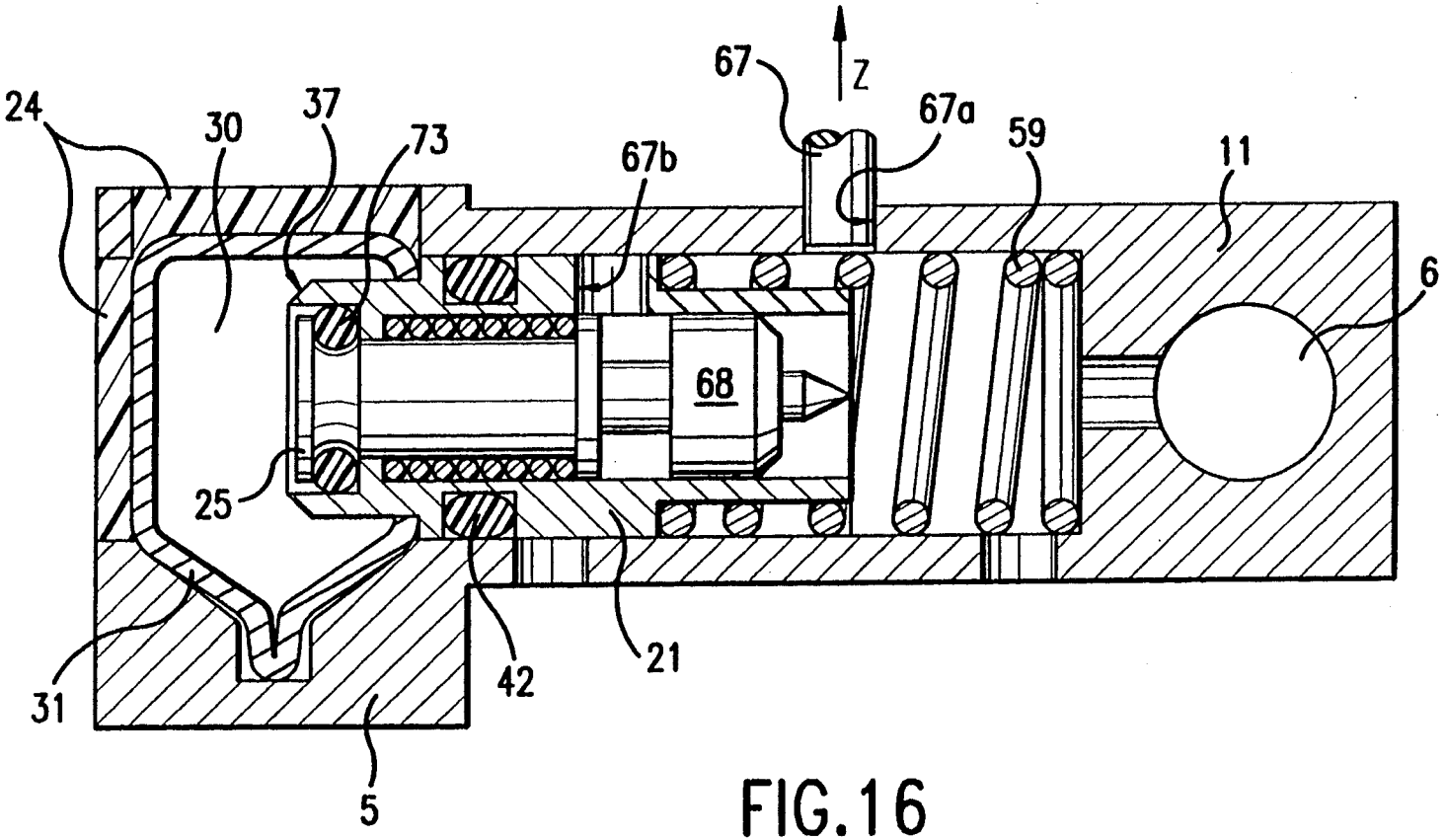
FIG. 16 is a cross-section view FIG. 9 showing the system after projection of the base toward the envelope.

FIG. 16 shows the system at the time when finger 67 is almost completely withdrawn from slide 5. The finger leaves orifice **67*b* which has the effect of releasing base 21 which is projected onto envelope 31 by the urging of spring 59. Envelope 31 is burst by a frontal part 37 of base 21 which has a beveled shape. Holding element 25 then comes in contact with corrosive agent 30**.

O-rings 73 and 42 prevent corrosive agent 30 from spreading in receptacle **5*b* of slide 5 once envelope 31** has been perforated.

Such an arrangement adds to the reliability of the self-destruct system because it guarantees that the holding element will come in contact with all of the corrosive agent regardless of the position of the submunition on the ground.

Moreover, spring 59 ensures projection of the base and maintenance of the corrosive agent under pressure after envelope 31 has burst. The O-rings ensure that the corrosive agent is kept under pressure without leaking.

Such an arrangement minimizes the volume of the residual air bubble remaining in the ampule once it has been closed, providing good wetting of holding element 25 and hence good reproducibility of the conditions under which the latter is attacked by corrosive agent 30. This reproducibility is ensured whatever the position on the ground of the submunition throughout the utilization temperature range, affording excellent reliability of the self-destruct system.

Pressurization of the corrosive agent by the projection means associated with the sealing rings is also ensured in all the embodiments described above.

Once holding element 25 has been released, the corrosive agent can spread in receptacle 5b of the slide, which is of no consequence because secondary striker 15 has been released and has initiated detonator 6.

In general, in all the embodiments described above, an acid (such as hydrochloric acid or sulfuric acid) can be used as the corrosive agent and a metal such as aluminum as the material for the holding element.

The holding element can also be made of a plastic of the polycarbonate type and a solvent such as trichloroethylene can be used as the corrosive agent.

It is preferable to combine the polycarbonate (sold under the trade name Makrolon) with a solvent composed of a mixture of 40 vol. % methyl isobutyl ketone and 60% methyl ethyl ketone. The materials used for making the holding element must have minimum internal tension to ensure reproducibility of the corrosion times. Thus, polycarbonates made by casting are preferred.

In the third embodiment described above, it is also preferable to provide means that avoid stressing the holding element during the storage phases.

Figure 8:
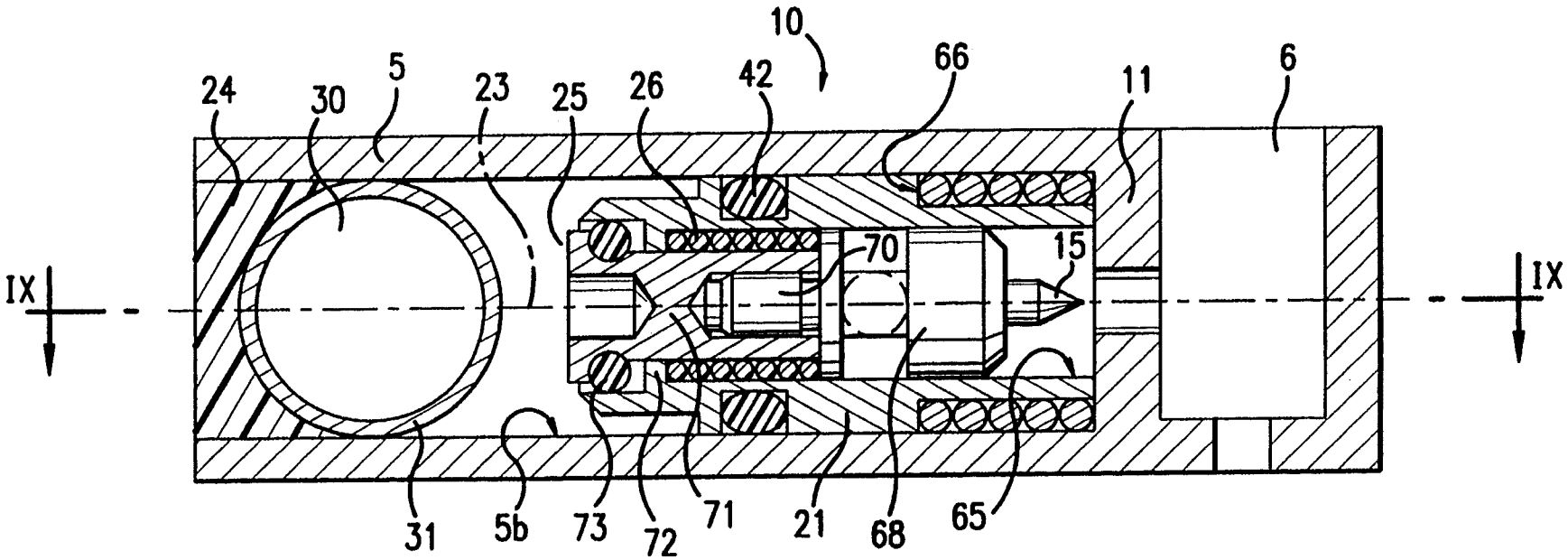
FIG. 8 is a cross-section view of FIG. 9 along plane VIII—VIII of a self-destruct system according to a third embodiment of the invention.
Figure 9:
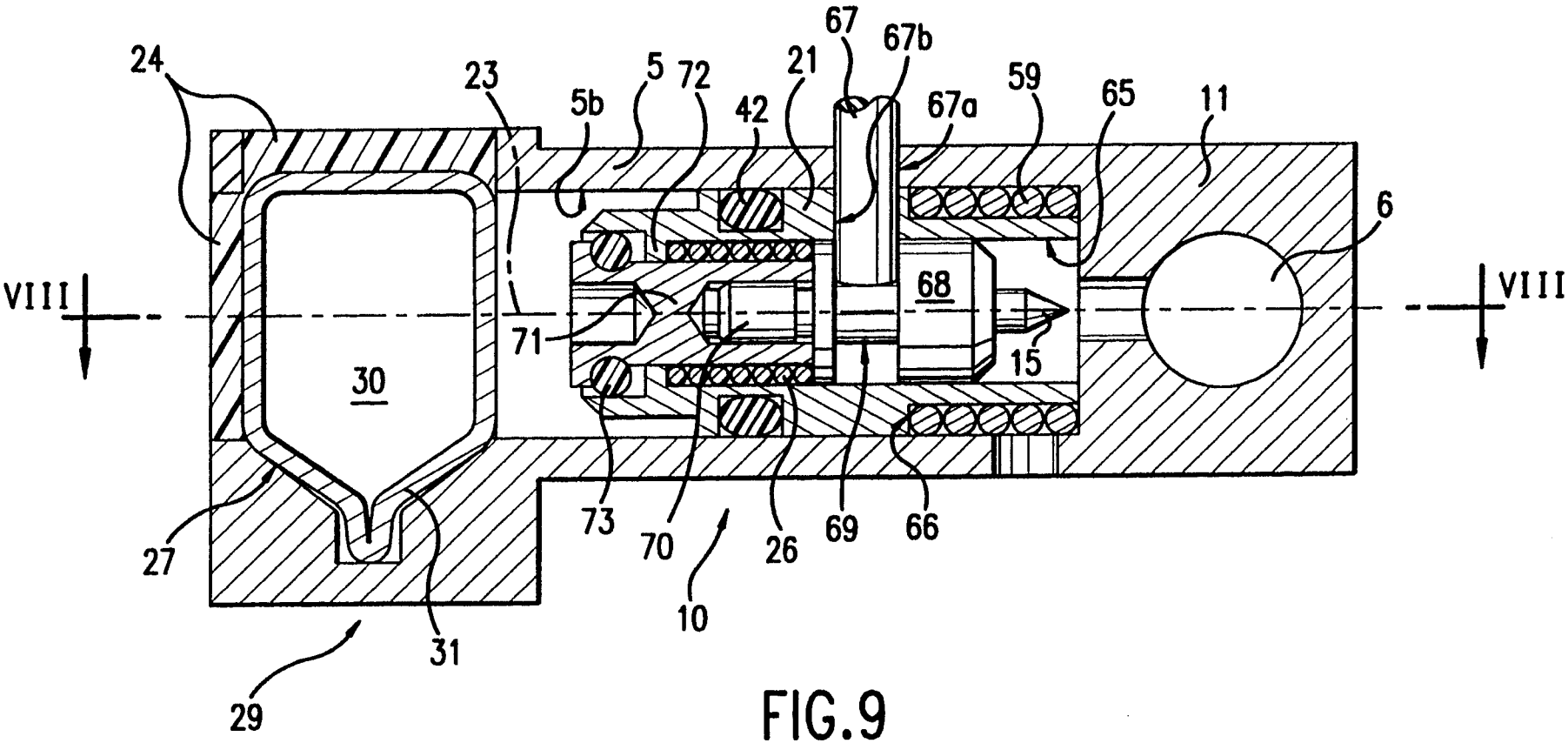
FIG. 9 is a cross-section view of FIG. 8 along plane IX—IX.

The values of the desired delays can be modulated by adjusting the weight of the holding element and the size of its surface in contact with the corrosive agents (for example by providing an axial orifice in holding element 25 as shown in FIGS. 8 and 9). The pressure exerted on the corrosive agent by the spring constituting the projection means can also be varied.

FIGS. 10 to 14 show how this third embodiment is built into a bomblet type submunition 50. Submunition 50 has a safety and arming device 51 whose body 53 has a receptacle 52 for slide 5.

Safety and arming device 51 also has main striker 2 which is screwed into nut 55. In known fashion, the main striker has a stabilizer strip (not shown here) which is designed to position the submunition correctly relative to the ground when it is released and then unscrew striker 2 from nut 55.

Figure 10:
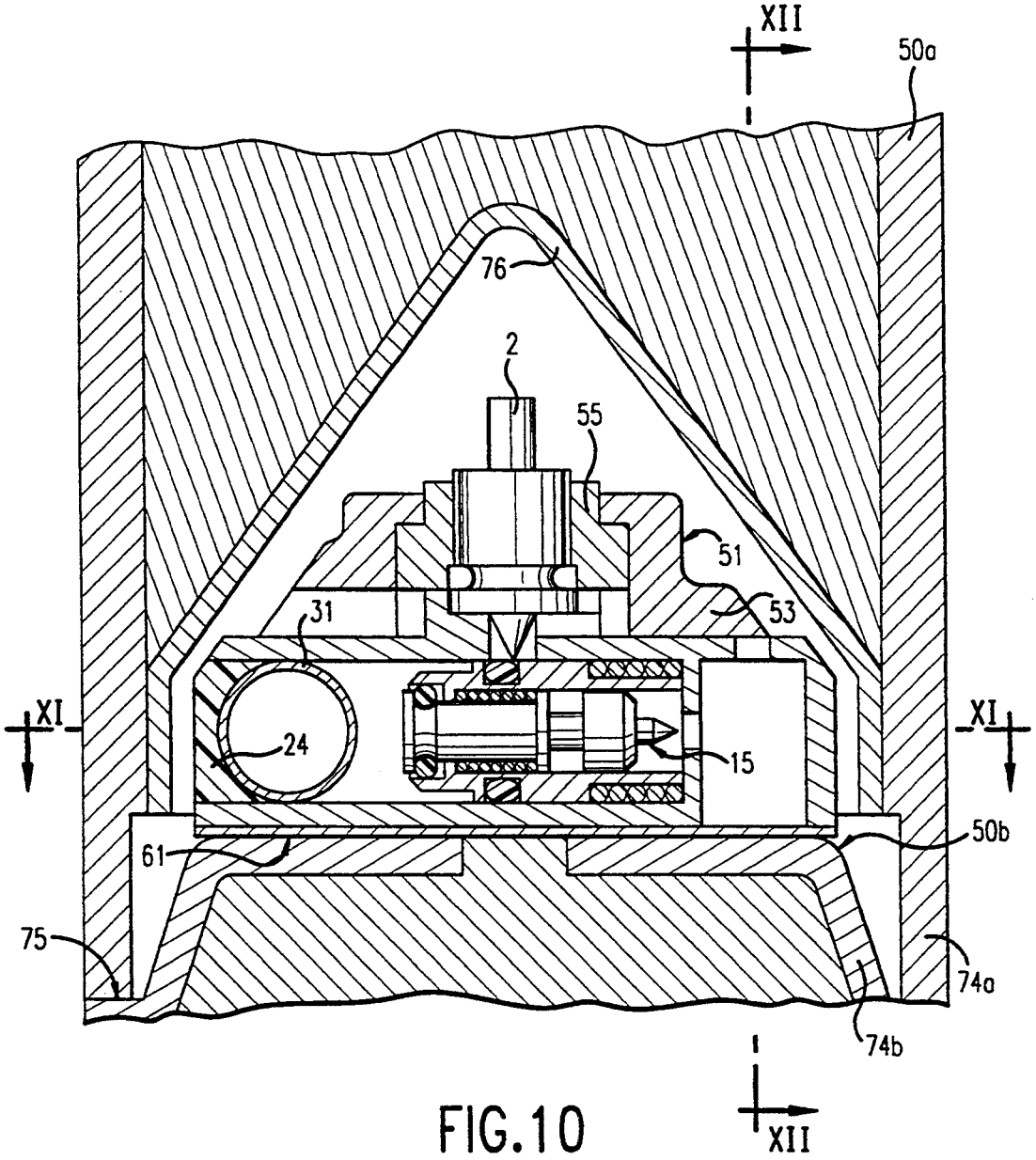
FIG. 10 is a section view along plane XI—XI of FIG. 11 showing the assembly of the self-destruct system according to this third embodiment in a submunition.

FIG. 10 partially shows two submunitions 50a and 50b as they are positioned inside a carrier shell. Envelope 74a of submunition 50a abuts a shoulder 75 provided on envelope 74b of submunition 50b. Safety and arming device 51 is then accommodated in the internal space delimited by the charge covering 76 of submunition 50a.

Figure 11:
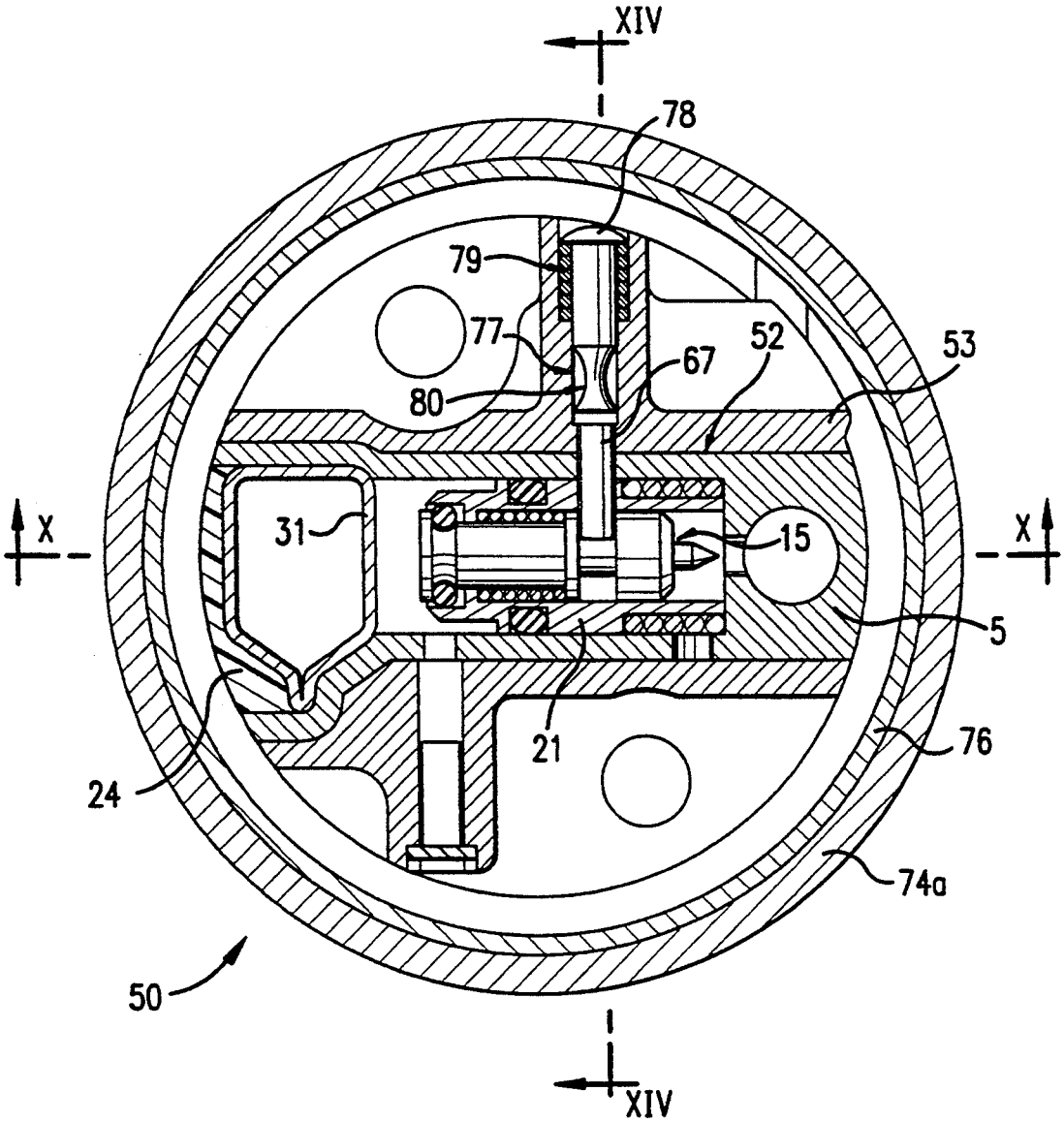
FIG. 11 is a section view through FIG. 10 along plane XI—XI.
Figure 14:
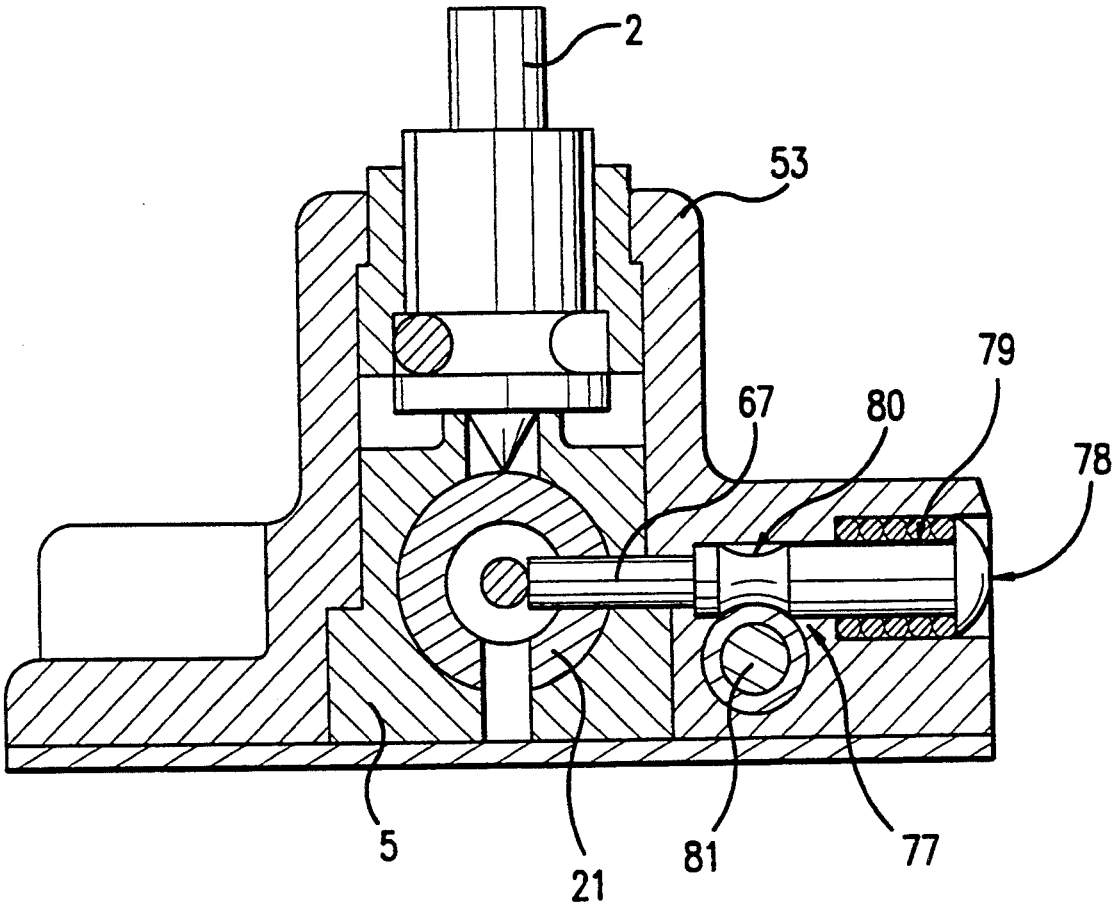
FIG. 14 is a section through FIG. 11 along plane XIV—XIV.

With reference now to FIGS. 11 and 14 (FIG. 14 shows the safety and arming device alone), it will be seen that finger 67, which both immobilizes base 21 relative to slide 5 and immobilizes secondary striker 15 relative to the base, is slidably mounted in a receptacle 77 provided in body 53.

Finger 67 has an enlarged end 78 oriented toward the outside of body 53 on which one end of an ejection spring 79 rests. The other end of this spring rests on body 53. Finger 67 has a recess 80 designed to receive a bolt 81 whose axis is perpendicular to the axis of finger 67.

Figure 12:
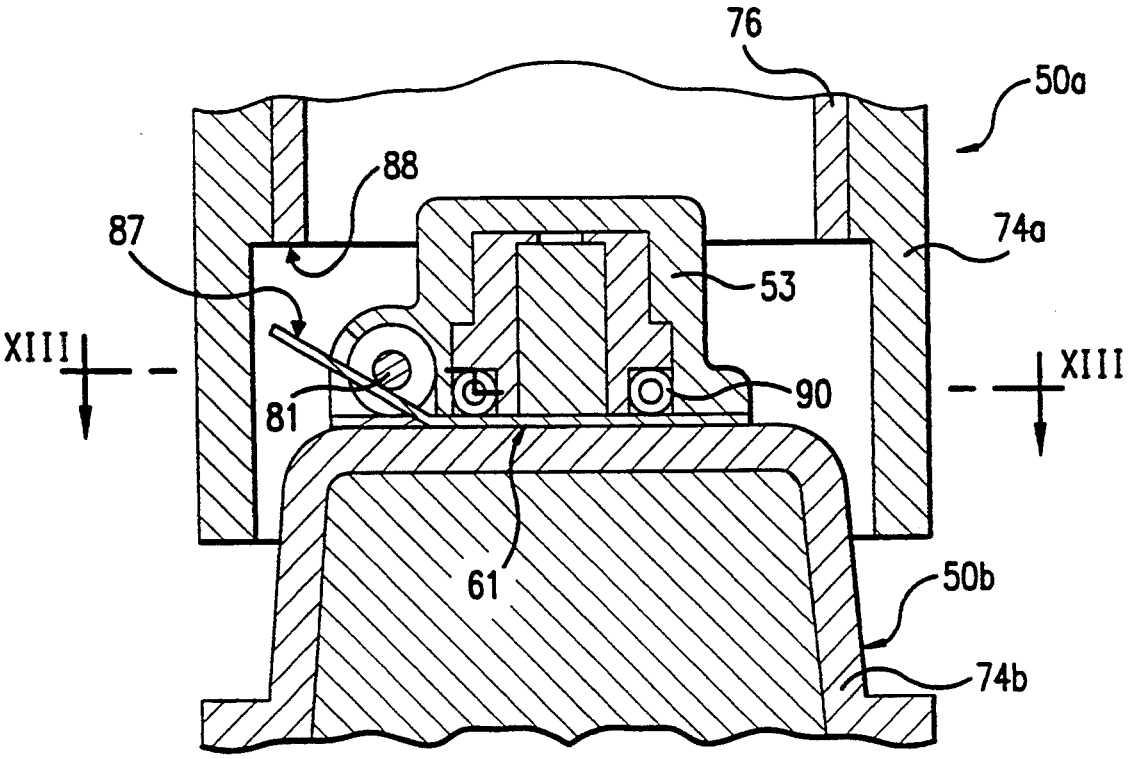
FIG. 12 is a section view through FIG. 10 along plane XII—XII.
Figure 13:
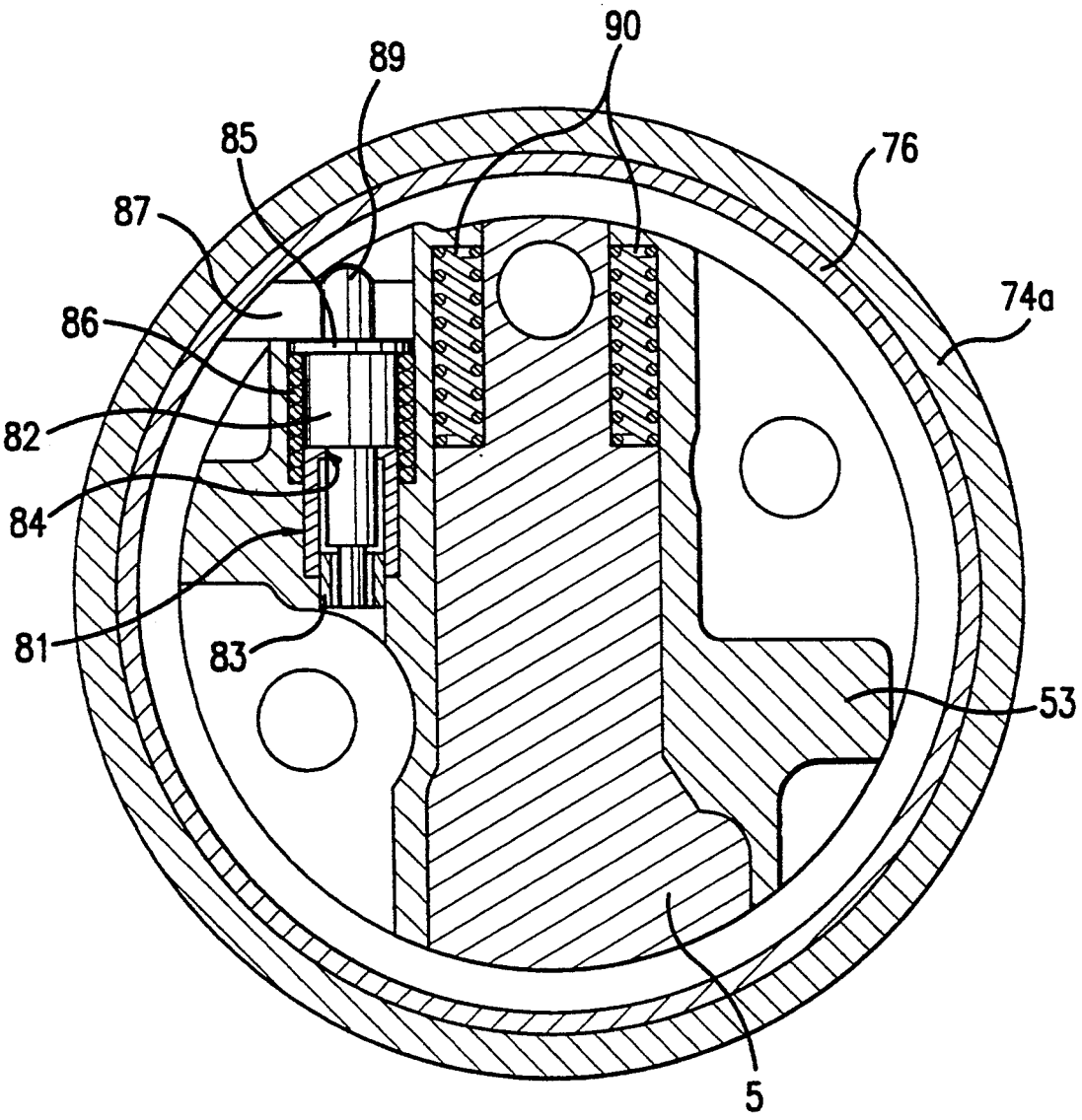
FIG. 13 is a section view through FIG. 12 along plane XIII—XIII.

FIGS. 12 and 13 show bolt 81 more precisely. The latter is composed of a cylindrical sleeve adjusted in a corresponding receptacle provided in body 53. A rod 82 is mounted telescopically in sleeve 81. It has a washer 83 attached to its rear part which is able to abut a crease 84 in sleeve 81.

Rod 82 also has a shoulder 85 on which an ejection spring 86 rests. The other end of this spring rests on a shoulder of the receptacle of sleeve 81. Ejection spring 86 is shown compressed in FIG. 13.

A bottom plate 61, preferably made of sheet steel, ensures the closure of safety and arming device 51. A tongue 87 is cut out of bottom plate 61. In the resting position, tongue 87 assumes the position shown in FIG. 12 in which it constitutes a stop for shoulder 85 of rod 82. Thus tongue 87 holds spring 86 in the compressed state by means of rod 82.

When the submunitions are stacked before being loaded into the carrier shell, shoulder 88 of envelope 74a of submunition 50a comes to rest on tongue 87 and deforms it elastically so that it no longer provides a stop for shoulder 85 of rod 82. Ejection spring 86 then pushes the finger toward the outside of body 53 of safety and arming device 51. A rounded end 89 of rod 82 then abuts the charge covering 76. This movement of the rod is not of sufficient amplitude to cause bolt 81 to be withdrawn.

When the submunitions are dispersed, they separate from each other under the effect of the aerodynamic forces. Rod 82 then no longer abuts the charge covering of the adjacent submunition. Ejection spring 86 thus causes rod 82 to be ejected completely, which also entrains bolt 81 by means of washer 83. Once bolt 81 is withdrawn, finger 67 is no longer immobilized. In its turn it is ejected outside body 53 by its spring 79. Ejection of spring 67 causes initiation of the self-destruct system described above.

It will be noted that initiation of this system occurs at the time the submunitions are dispersed and before slide 5, pushed by its arming springs 90, adopts an armed position.

Hence, this particular embodiment is particularly reliable since it ensures initiation of self-destruction even if the arming of the slide should fail.

A number of variations are possible without departing from the framework of the invention. Thus it is possible to use the self-destruct system according to the invention in various submunitions, for example in dispersible mines or anti-tank submunitions provided with infrared or millimeter wave target detectors.

What is claimed is:

1. A system for self-destruction of a munition having a submunition dispersible by a vehicle, the munition having a priming device including a slide, the slide comprising a slide receptacle and being movable between a safety position and an armed position, and a warhead priming system, said self-destruction system comprising:

a secondary striker mounted within the slide receptacle, said secondary striker being movable between a safety position and a position in which the warhead priming system is struck;

a control device for releasing said secondary striker after a preset delay;

a base disposed within the slide receptacle;

a holding element resting on said base, wherein said secondary striker is integral with said holding element;

wherein said control device comprises:

an envelope containing a corrosive agent for corroding said holding element to release said holding element from said base after said preset delay to cause said secondary striker to move toward said warhead priming system;

a perforator for perforating said envelope;

a projector for causing contact between said envelope and said holding element, said projector including a projector spring and a locking element, said locking element maintaining said spring in a tensioned state; and a seal for preventing said corrosive agent from spreading into the slide receptacle after said envelope is perforated by said perforator and before said holding element is released.

2. The system according to claim 1, further comprising a piston connected to said spring so as to be translationally moveable, wherein said envelope is supported on said piston.

3. The system according to claim 1, wherein said holding element is made of a metal and said corrosive agent comprises an acid.

4. The system according to claim 3, wherein said holding element is made of a plastic material and said corrosive agent comprises a solvent.

5. A system for self-destruction of a munition having a submunition dispersible by a carrier, the munition having a primary device including a slide, said slide comprising slide receptacle and being moveable between a safety position and an armed position, and a device for priming a warhead, said system for self-destruction comprising:

a secondary striker mounted within the slide receptacle, said secondary striker being moveable between a safety position and a priming device striking position;

a control device for releasing said secondary striker after a preset delay;

a base disposed within the slide receptacle;

a holding element and an arming spring, said holding element being held on said base by said arming spring;

said control device comprising:

an envelope containing a corrosive material for chemically attacking said holding element to release said holding element from said base after said preset delay to move said secondary striker in a direction of said primer device;

a fixed member;

a perforator for perforating said envelope;

a projector for projecting said base in the direction of said fixed member; and a seal for preventing said corrosive material from spreading into said slide receptacle after said envelope has been perforated by said perforator for perforating and before said holding element is released.

6. The system according to claim 5, wherein said projector comprises:

a locking ball disposed within said slide between said base and said envelope and a plurality of springs for holding said locking ball under tension, wherein said locking ball releases said base when the slide moves into said armed position.

7. The system according to claim 6, wherein said base has two lateral wings which project outside said slide, and said plurality of springs are connected to said slide and said body to urge said slide to move into the armed position.

8. The system according to claim 5, wherein said projector comprises a projecting spring connected at one end to said base and at the other end to said slide, and a finger which joins said base to said slide and maintains said projecting spring in a compressed state.

9. The system according to claim 8, wherein said finger connects said secondary striker to said base, said arming spring being held compressed between said base and said secondary striker, and withdrawal of said finger causes said holding element to act on said base by the action of said arming spring.

10. The system according to claim 9, wherein said seal comprises a first O-ring disposed in an annular recess provided on the outer surface of said base and a second O-ring disposed between said holding element and said base.

11. The system according to claim 8, further comprising a bolt and an ejecting spring for ejecting said bolt such that said bolt immobilizes said finger, said bolt having an axis perpendicular to an axis of said finger.

12. The system according to claim 11, wherein said bolt is ejected by said ejecting spring which is held in the compressed state by an adjacent submunition when the submunitions are loaded into a vehicle.

13. The system according to claim 12, further comprising an elastic tongue which contacts said ejecting spring to maintain said ejecting spring in a compressed state before the submunition is loaded into a vehicle, wherein said tongue is pushed aside by an adjacent submunition when submunitions are loaded into a vehicle.

* * * * *